US011708742B2

(12) United States Patent
Tubel

(10) Patent No.: US 11,708,742 B2
(45) Date of Patent: Jul. 25, 2023

(54) SYSTEM TO CONTROL AND OPTIMIZE THE INJECTION OF CO2 AND REAL TIME MONITORING OF CO2 PLUME LEAKS

(71) Applicant: Tubel LLC, The Woodlands, TX (US)

(72) Inventor: Paulo Tubel, The Woodlands, TX (US)

(73) Assignee: Tubel LLC, The Woodlands, TX (US)

( * ) Notice: Subject to any disclaimer, the term of this patent is extended or adjusted under 35 U.S.C. 154(b) by 179 days.

(21) Appl. No.: 17/171,074

(22) Filed: Feb. 9, 2021

(65) Prior Publication Data

US 2022/0251925 A1 Aug. 11, 2022

(51) Int. Cl.

| | |
|---|---|
| ***E21B 34/06*** | (2006.01) |
| ***E21B 34/14*** | (2006.01) |
| ***E21B 43/26*** | (2006.01) |
| ***E21B 47/06*** | (2012.01) |
| ***E21B 43/12*** | (2006.01) |

(52) U.S. Cl.

CPC ..... *E21B 34/066* (2013.01); *E21B 34/14* (2013.01); *E21B 43/12* (2013.01); *E21B 43/26* (2013.01); *E21B 47/06* (2013.01); *E21B 2200/06* (2020.05)

(58) Field of Classification Search

CPC ..... E21B 34/066; E21B 34/14; E21B 43/12; E21B 43/26; E21B 47/06; E21B 2200/06

See application file for complete search history.

(56) References Cited

U.S. PATENT DOCUMENTS 5,955,666 A * 9/1999 Mullins ..... E21B 43/16 340/853.2

2002/0020533 A1* 2/2002 Tubel ..... E21B 43/01 166/50

(Continued)

*Primary Examiner* — Tara Schimpf

(74) *Attorney, Agent, or Firm* — Maze IP Law, P.C.

(57) ABSTRACT

Injection of $CO_2$ may be controlled and optimized, and $CO_2$ plume leaks monitored in real time, using a controlled sleeve system deployed into a well, where the controlled sleeve system comprises a predetermined set of ports extending from an outer surface of a substantially tubular housing through to an inner annulus of the housing and one or more selectively actuated sliding sleeves configured to selectively open, occlude, and close the predetermined set of ports. One or more sensors configured to be deployed in the well may be present. A wireless remotely actuated flow controller disposed at least partially within the housing and operatively in communication with the sensor comprises a sleeve actuator controller operatively connected to the selectively actuated sliding sleeve and a sensor data acquisition module operatively in communication with the sensor. A communications module is operatively in communication with the wireless remote actuated flow controller. Power may be supplied via a power supply operatively in communication with the wireless remote actuated flow controller, the communications module, and the sensor. The controlled sleeve system is placed into communication with a surface control system disposed proximate a surface location of the well and $CO_2$ injected into a geological formation of the well, at least partially through the controlled sleeve system. The surface system is used to selectively actuate the selectively actuated sleeve to selectively choke, occlude, and permit the flow of $CO_2$.

20 Claims, 3 Drawing Sheets

(56) References Cited

U.S. PATENT DOCUMENTS

| | | | | |
|---|---|---|---|---|
| 2009/0034368 | A1* | 2/2009 | Johnson | E21B 47/14 367/83 |
| 2014/0069639 | A1* | 3/2014 | Mackenzie | E21B 21/10 166/250.01 |
| 2016/0312579 | A1* | 10/2016 | Green | E21B 34/10 |
| 2019/0249549 | A1* | 8/2019 | Fripp | E21B 34/14 |

* cited by examiner

SYSTEM TO CONTROL AND OPTIMIZE THE INJECTION OF CO2 AND REAL TIME MONITORING OF CO2 PLUME LEAKS

BACKGROUND

One of the techniques to store $CO_2$ is to inject it in geological formations deep into the Earth. This technique may also be used to optimize the production of hydrocarbon by injecting $CO_2$ in producing zones to push hydrocarbons to producing wells associated with the same formations.

Injection of $CO_2$ in wells helps reduce $CO_2$ emission in the atmosphere and consequently provide an improvement and reduction of effects of climate change. Injector wells are typically used to provide a conduit to deploy $CO_2$ into permeable geological formations that can store the $CO_2$.

Current techniques include using sliding sleeves that allow $CO_2$ to go from the inside of tubing into the geological formations. These sleeves can be actuated hydraulic from the surface or mechanically by intervening in the well. However, the injection of $CO_2$ in wells is done blindly without the support of any data from inside the well. This process becomes very inefficient and it is difficult to verify where the $CO_2$ is actually injected. There is no information on the opening port size on the sleeve to allow the $CO_2$ to enter the formations or if there are leaks in the well.

FIGURES

Various figures are included herein which illustrate aspects of embodiments of the disclosed inventions.

DESCRIPTION OF EXEMPLARY EMBODIMENTS

Figure 1:
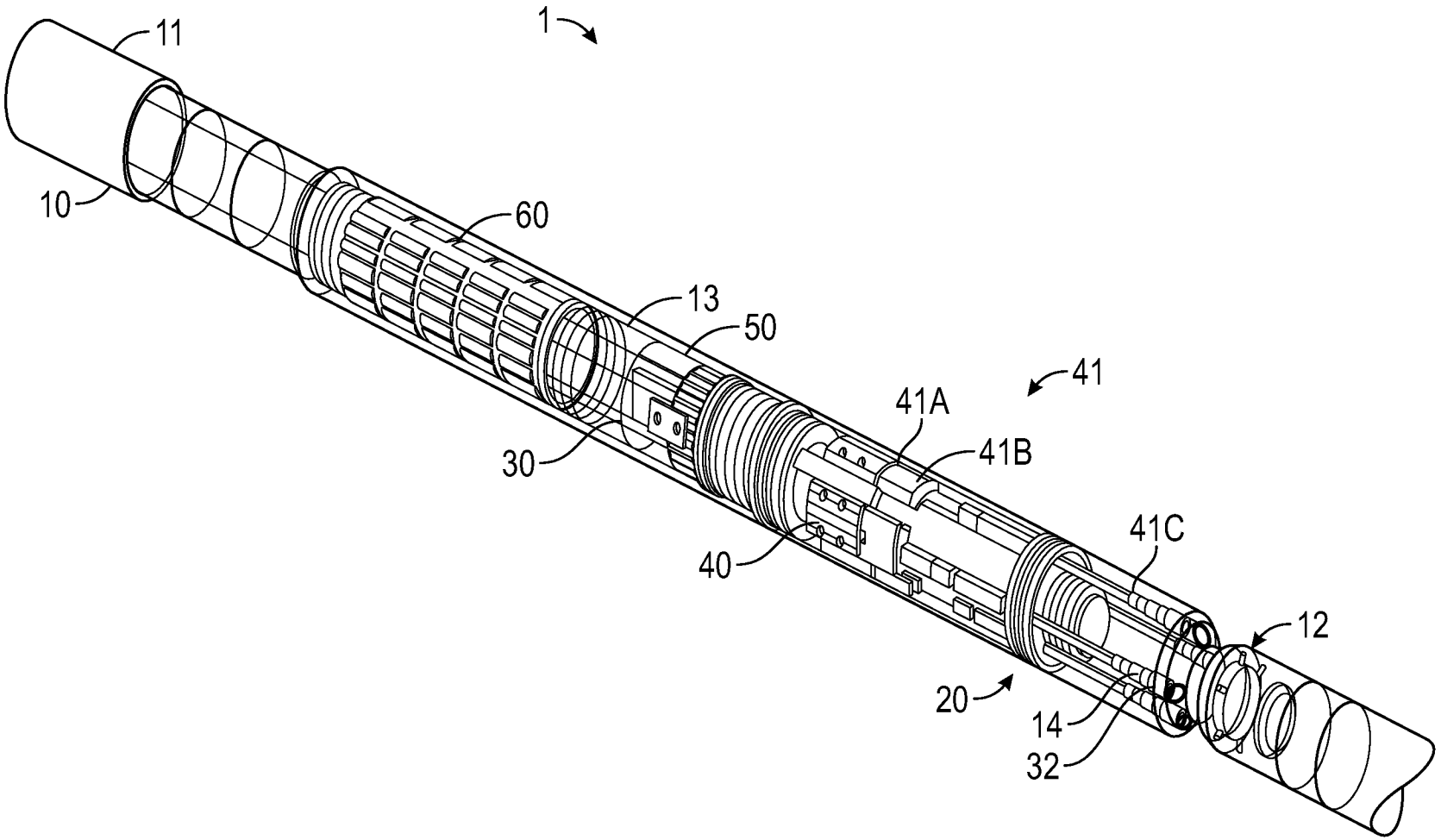
FIG. 1 is a cutaway view in partial perspective of an exemplary controlled system.

In a first embodiment, referring generally to FIG. 1, controlled sleeve system 1 comprises substantially tubular housing 10 comprising first end 11 and second end 12; a predetermined set of ports 14 disposed proximate second end 12 of housing 10, each port 14 (e.g., 20*a*, 20*b*, and the like) extending from an outer surface of housing 10 through housing 10 to an inner annulus of housing 10; one or more selectively actuated sliding sleeves 20 configured to selectively open, occlude, and/or close the predetermined set of ports 14; sensor 30 configured to be deployed in well 200; wireless remotely actuated flow controller 40 disposed at least partially within housing 10 and operatively in communication with sensor 30 such as to allow the movement of $CO_2$ from the tubing into the geological formations; communications module 50, typically added to or otherwise in communication with selectively actuated sliding sleeve 20 to allow for receiving commands from the surface to control the opening, closing, and/or choking of a flow path to the formation for $CO_2$ and to receive data from downhole, operatively in communication with wireless remote actuated flow controller 40; and power supply 60 operatively connected to wireless remote actuated flow controller 40, communications module 50, and sensor 30.

Selectively actuated sleeve 20 may comprise an electronically actuated, wirelessly accessible sliding sleeve, a cable actuated sleeve, or the like.

Sensor 30 may comprise a pressure sensor, a temperature sensor, a strain sensor, a downhole flow meter, and/or a Severinghaus sensor which can aid in detecting $CO_2$. As one of ordinary skill in sensor technology understands, a Severinghaus sensor is a modified glass electrode which contains sodium bicarbonate for reacting with $CO_2$. A reaction changes pH in the electrode which is related to a voltage change in the assembly. The change in voltage is related to an amount of $CO_2$.

Sensor 30 may be a standalone sensor and may further be sized to fit within in well 200, such as into a small space in well 200 where small means a space between a tubular deployed in a wellbore and its surrounding formation or a space between a production tubing and a drill tubing into which the production tubing is deployed. In addition, sensor 30 can be part of or otherwise integrated into wireless remotely actuated flow controller 40.

Figure 2:
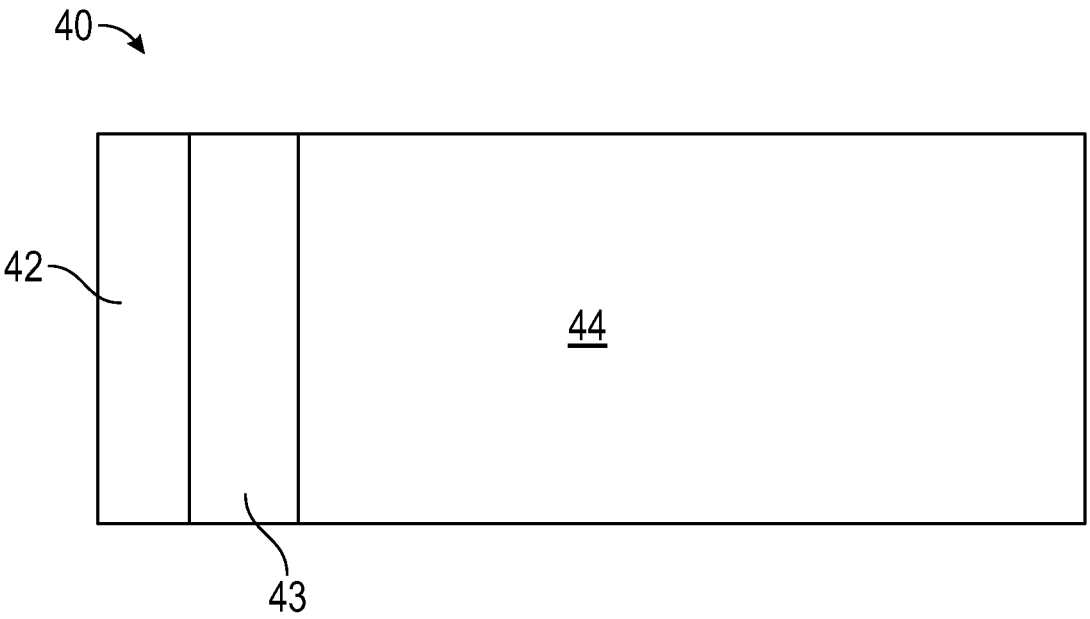
FIG. 2 is a block diagram of an exemplary wireless remotely actuated flow controller.

In embodiments, referring additionally to FIG. 2, wireless remotely actuated flow controller 40 comprises one or more low power wireless remote actuated flow controllers 40. In certain embodiments, wireless remotely actuated flow controller 40 comprises one or more sleeve actuator controllers 41 operatively connected to selectively actuated sliding sleeve 20; and one or more sensor data acquisition modules 42 operatively in communication with sensor 30. In certain embodiments, wireless remotely actuated flow controller 40 comprises one or more sleeve actuator controllers 41; analog to digital converter 43; writable memory 44, e.g., a data store such as solid-state memory; and data communicator 44. In certain embodiments, sleeve actuator controller 41 comprises a plurality of motors 41A; one or more motor drivers 41B operatively in communication with the plurality of motors 41A; and one or more sleeve actuators 41C, e.g., a ball nut and lead screw assembly, operatively connected to a motor 41A of the plurality of motors 41A.

Motor 41A may comprise an electric motor, e.g., a DC electric motor, and motor driver 41B comprise an electric motor driver 41B operatively connected to electric motor 41A. Typically, electric motor driver 41B will provide energy and timing to DC electric motors 41A.

Communications module 50 is typically configured to allow for reception of commands from the surface of well 200 to control the opening, closing, and/or choking of a flow path to the formation for $CO_2$ and to transmit data from downhole to surface system 200. Communications module 50 is also typically configured to be operatively in communication with wireless remote actuated flow controller 40. Communications module 50 typically comprises a wireless or wire based bidirectional transceiver or combination thereof.

Figure 3:
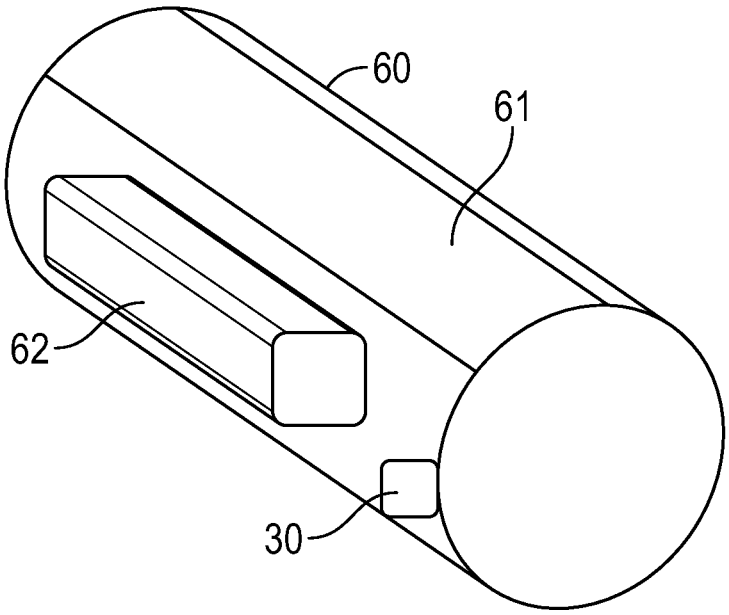
FIG. 3 is a block diagram of an exemplary power supply.

Referring additionally to FIG. 3, power supply 60 may comprise one or more batteries, which can be rechargeable, or a downhole power generator, or the like, or a combination thereof. If power supply 60 comprises a predetermined set of batteries, power supply 60 may further comprise one or more power converters operatively in communication with the predetermined set of batteries which can convert electrical power from the predetermined set of batteries into voltage levels required for electronics and motor operation of controlled sleeve system 1.

In certain embodiments, power supply 60 comprises pressure housing 61 at least partially disposed within housing 10 and one or more rechargeable batteries 62 at least partially disposed within pressure housing 61. If pressure housing 61 is present, sensor 30 may be at least partially contained within pressure housing 61.

In certain embodiments, controlled sleeve system 1 may further comprise pressure housing 13, configured to contain electronics, one or more sensors 30, power supply 60 (e.g., batteries), and one or more sleeve actuator controllers 41 (which may be microprocessor based) configured for control, command, and data acquisition, and one or more associated motors 41A, motor drivers 41B operatively in communication with motors 41A, and sleeve actuators 41C.

Although the actual number of ports 14 may vary, in a preferred embodiment there are four such ports 14, disposed substantially equally circumferentially about housing 10. If there are a plurality of ports 14, in certain embodiments selectively actuated sliding sleeve 20 comprises a corresponding plurality of selectively actuated sliding sleeves 20, each such selectively actuated sliding sleeve 20 of the plurality of selectively actuated sliding sleeves 20 associated with a corresponding port 14 of the plurality of ports 14 and autonomously operatable with respect to the other selectively actuated sliding sleeves 20. In embodiments, wireless remotely actuated flow controller 40 comprises a separate motor 41A, motor driver 41B operatively in communication with motor 41A, and sleeve actuator 41C for each sleeve actuator controller 41 of the plurality of selectively actuated sliding sleeves 20.

In embodiments, controlled sleeve system 1 further comprises a predetermined set of feedback loop and position sensors 32 corresponding to, and operatively in communication with, the plurality of selectively actuated accessible sliding sleeves 20, useful, e.g., to provide data helping to aid in opening of selectively actuated accessible sliding sleeves 20 such as to control the open/close process.

Figure 4:
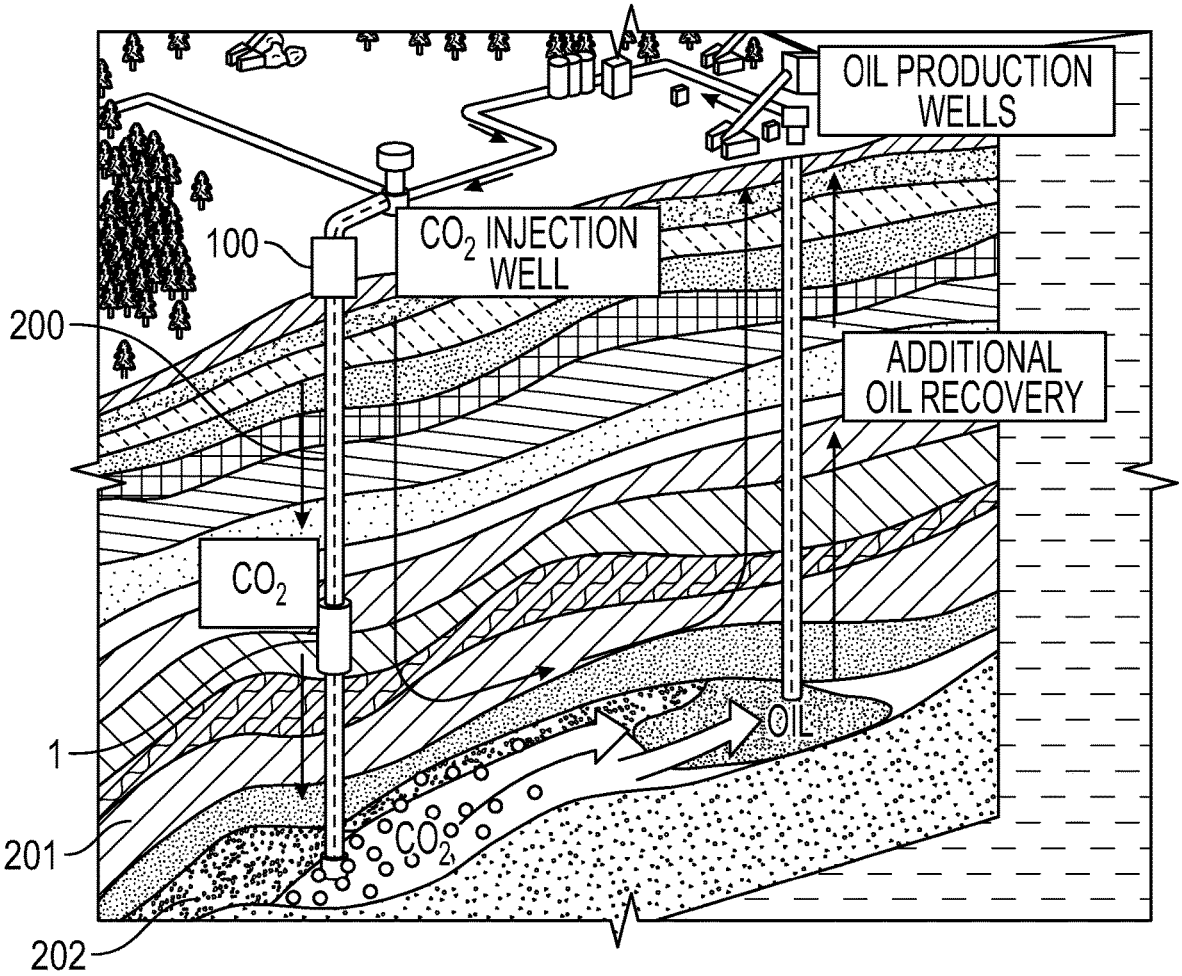
FIG. 4 is a block diagram of an exemplary system to control and optimize the injection of $CO_2$ and real time monitoring of $CO_2$ plume leaks.
Figure 5:
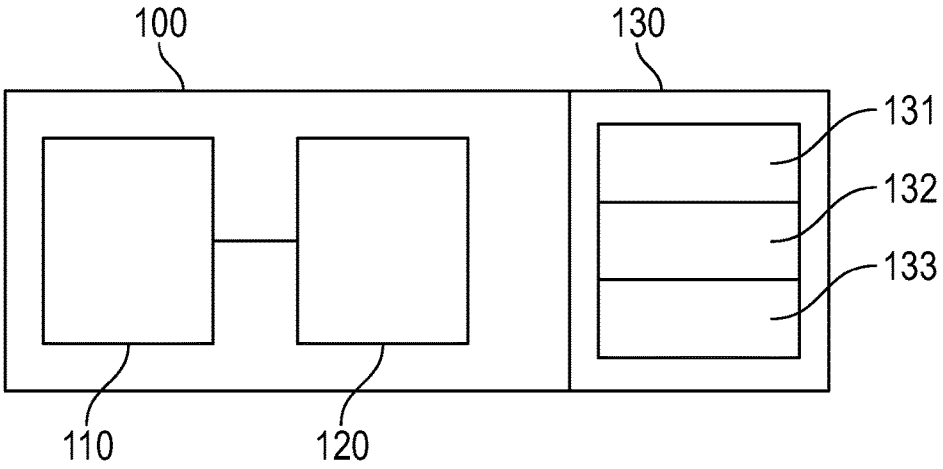
FIG. 5 is a block diagram of an exemplary surface control system.

Referring additionally to FIG. 4 and FIG. 5, a system to control and optimize the injection of $CO_2$ and provide real time monitoring of $CO_2$ plume leaks 2 comprises controlled sleeve system 1, described above, and surface control system 100 operatively in communication with sleeve system 1. In embodiments, surface control system 100 comprises data processor 110 and bidirectional data communicator 120 which is operatively in communication with wireless remotely actuated flow controller 40 in real time and/or data processor 110. Typically, surface control system 100 is responsible for data communication and command transfer between surface control system 100 and sleeve system 1.

Data processor 110 typically comprises a command detection and decoding module, e.g., hardware and software which can detect a signal from sleeve system 1 such as an acoustic signal and decode that signal into useful data.

In embodiments, surface system 100 further comprises data acquisition and processing system 130; data transceiver 131, which is operatively complimentary to the wireless communications module; one or more data transfer ports 132; and one or more specialized data interfaces 133, e.g., an Internet of Things data interface.

Data transceiver 131 may comprise a pressure pulse data transceiver and a hydraulic pressure pulse generator operatively in communication with the pressure pulse data transceiver.

In the operation of exemplary methods, referring back to FIG. 1 and FIG. 4, controlled sleeve system 1 may be used by deploying controlled sleeve system 1 into well 200, where controlled sleeve system 1 is as described above, and deploying surface control system 100 at a surface location proximate well 200 where surface control system 100 is as described above. Typically, this is done as part of deploying system to control and optimize the injection of $CO_2$ and real time monitoring of $CO_2$ plume leaks in well 200 where $CO_2$ is injected or to be injected into one or more geological formations 201,202 of well 200, at least partially through controlled sleeve system 1 and surface system 100 used to selectively actuate selectively actuated sleeve 20 to selectively choke, occlude, and/or permit the flow of $CO_2$ by opening and closing one or more ports 14 of the plurality of ports 14 in response to one or more commands from surface system 200 to equalize pressure in well 200. In embodiments, selectively actuated sliding sleeve 20 can fully open and/or fully close the predetermined set of ports 14 and still choke fluid flow.

Deploying controlled sleeve system 1 may be accomplished through tubing by using a slickline, an electric line, or the like. Alternatively, deploying controlled sleeve system 1 may be accomplished attaching controlled sleeve system 1 to tubing or casing and deploying attached controlled sleeve system 1 in well 200 along with the tubing or the casing.

Where the geological formation comprises a plurality of geological formations 201,202, surface system 100 may selectively actuate one or more selectively actuated sliding sleeves 20 to selectively allow and/or choke the flow of $CO_2$ by opening and closing the plurality of ports 14 in response to a command from surface system 200 to equalize the pressure in well 200 to inject a substantially equal amount of $CO_2$ into each geological formation 201,202 of the plurality of geological formations 201,202.

If deploying controlled sleeve system 1 further comprises deploying multiple controlled sleeve systems 1 in well 200, multiple controlled sleeve systems 1 may be deployed into a corresponding set of multiple geological zones 201,202 and operated substantially simultaneously to receive the $CO_2$ substantially simultaneously, which, in turn, can increase an amount of $CO_2$ volume that can be injected in well 200 over a period of time. In other embodiments, one or more controlled sleeve systems 1 may be operated substantially independently in well 200.

In most embodiments, sensor 30 is used to determine pressure in well 200, especially where $CO_2$ is being injected to optimize the process, provide strain measurements for communications detection in well 200, detect leaks due to pressure changes in a well tubular, or the like, or a combination thereof. Sensor 30 may be part of controlled sleeve system 1, e.g. integrated into controlled sleeve system 1, or may be an independent sensor in the well. In certain embodiments, one or more sensors 30 are permanently deployed in well 200.

Data and commands may be transmitted and received between surface system 200 and controlled sleeve system 1 wirelessly such as by using acoustic pulses created at the surface and detected downhole into well 200. Acoustic pulse communications may use well tubing as a conduit for the acoustic waves.

In certain embodiments, data may be transferred to another module on site or via the Internet to a secure website or a remote location, e.g., via a USB bus or the like.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A controlled sleeve system, comprising:

a) a substantially tubular housing comprising a first end and a second end;

b) a predetermined set of ports disposed proximate the second end of the housing, each port extending from an outer surface of the housing through the housing to an inner annulus of the housing;

c) a selectively actuated sliding sleeve configured to selectively open, occlude, and close the predetermined set of ports;

d) a sensor configured to be deployed in the well and determine pressure in the well, provide strain measurements for communications detection in the well, detect leaks due to pressure changes in a well tubular, or a combination thereof;

e) a wireless remotely actuated flow controller disposed at least partially within the housing and operatively in wireless communication with the sensor, comprising:

i) a sleeve actuator controller operatively connected to the selectively actuated sliding sleeve; and ii) a sensor data acquisition module operatively in communication with the sensor;

f) a communications module operatively in communication with the wireless remote actuated flow controller; and g) a power supply operatively in communication with the wireless remote actuated flow controller, the communications module, and the sensor.

2. The controlled sleeve system of claim 1, wherein the selectively actuated sleeve comprises an electronically actuated, wirelessly accessible sliding sleeve or a cable actuated sleeve.

3. The controlled sleeve system of claim 1, wherein the sensor comprises standalone sensor or a sensor at least partially contained within the housing, the sensor comprising a pressure sensor, a strain sensor, a leak detection sensor, a temperature sensor, a downhole flow meter, a Severinghaus sensor, or a combination thereof.

4. The controlled sleeve system of claim 1, wherein the wireless remotely actuated flow controller comprises:

a) a sleeve actuator controller;

b) an analog to digital converter;

c) a writable memory; and d) a data communicator.

5. The controlled sleeve system of claim 1, wherein the sleeve actuator controller comprises:

a) an electric motor; and b) an electric motor driver operatively connected to the electric motor.

6. The controlled sleeve system of claim 1, wherein the communications module further comprises a bidirectional transceiver.

7. The controlled sleeve system of claim 1, wherein the power supply comprises a battery, a downhole power generator, or a combination thereof.

8. The controlled sleeve system of claim 1, wherein the power supply comprises:

a) a pressure housing at least partially disposed within the tubular housing; and b) a rechargeable battery at least partially disposed within the pressure housing.

9. The controlled sleeve system of claim 1, wherein the power supply comprises:

a) a predetermined set of batteries; and b) a power converter operatively in communication with the predetermined set of batteries.

10. The controlled sleeve system of claim 1, wherein:

a) the predetermined set of ports comprises four ports;

b) the selectively actuated sliding sleeve comprises a plurality of selectively actuated sliding sleeves, each selectively actuated sliding sleeve of the plurality of selectively actuated sliding sleeves associated with a corresponding port of the plurality of ports, each selectively actuated sliding sleeve of the plurality of selectively actuated sliding sleeves autonomously operatable with respect to the other selectively actuated sliding sleeves; and c) the controlled sleeve system comprises a predetermined set of feedback loop and position sensors corresponding to, and operatively in communication with, the plurality of electronically actuated, wirelessly accessible sliding sleeves.

11. A system to control and optimize the injection of $CO_2$ and real time monitoring of $CO_2$ plume leaks, comprising:

a) a controlled sleeve system, comprising:

i) a substantially tubular housing comprising a first end and a second end;

ii) a predetermined set of ports disposed proximate the second end of the housing, each port extending from an outer surface of the housing through the housing to an inner annulus of the housing;

iii) a selectively actuated sliding sleeve configured to selectively open, occlude, and close the predetermined set of ports;

iv) a sensor configured to be deployed in the well and determine pressure in the well, provide strain measurements for communications detection in the well, detect leaks due to pressure changes in a well tubular, or a combination thereof;

v) a wireless remotely actuated flow controller disposed at least partially within the housing and operatively in wireless communication with the sensor, comprising:

(1) a sleeve actuator controller operatively connected to the selectively actuated sliding sleeve; and (2) a sensor data acquisition module operatively in communication with the sensor;

vi) a communications module operatively in communication with the wireless remote actuated flow controller; and (a) a power supply operatively in communication with the wireless remote actuated flow controller, the communications module, and the sensor; and b) a surface control system operatively in communication with the sleeve system, the surface control system comprising:

i) a data processor; and ii) a bidirectional data communicator operatively in communication with the wireless remotely actuated flow controller in real time and with the data processor.

12. The system of claim 11, wherein the surface system comprises:

a) a data acquisition and processing system;

b) a data transceiver complimentarily in communication to the wireless communications module;

c) a data transfer port; and d) a specialized data interface.

13. The system of claim 12, wherein the data transceiver comprises:

a) a pressure pulse data transceiver; and b) a hydraulic pressure pulse generator operatively in communication with the pressure pulse data transceiver.

14. A method of controlling and optimizing injection of CO2 and real time monitoring of CO2 plume leaks, comprising:

a) deploying a controlled sleeve system into a well, the controlled sleeve system comprising:
   i) a substantially tubular housing comprising a first end and a second end;
   ii) a predetermined set of ports disposed proximate the second end of the housing, each port extending from an outer surface of the housing through the housing to an inner annulus of the housing;
   iii) a selectively actuated sliding sleeve configured to selectively open, occlude, and close the predetermined set of ports;
   iv) a sensor configured to be deployed in the well and determine pressure in the well, provide strain measurements for communications detection in the well, detect leaks due to pressure changes in a well tubular, or a combination thereof, the sensor comprising a pressure sensor, a strain sensor, a leak detection sensor, a temperature sensor, a downhole flow meter, a Severinghaus sensor, or a combination thereof;
   v) a wireless remotely actuated flow controller disposed at least partially within the housing and operatively in wireless communication with the sensor, comprising:
      (1) a sleeve actuator controller operatively connected to the selectively actuated sliding sleeve; and
      (2) a sensor data acquisition module operatively in communication with the sensor;
   vi) a communications module operatively in communication with the wireless remote actuated flow controller; and
      (a) a power supply operatively in communication with the wireless remote actuated flow controller, the communications module, and the sensor;

b) deploying a surface control system at a surface location of the well, the surface control system comprising:
   i) a data processor; and
   ii) a bidirectional data communicator operatively in communication with the wireless remotely actuated flow controller in real time and with the data processor; and c) operatively placing the surface control system in communication with the controlled sleeve system;

d) injecting $CO_2$ into a geological formation of the well, at least partially through the controlled sleeve system;

e) using the sensor to determine data related to the well, the sensed data comprising pressure in the well where the $CO_2$ is being injected, the sensed data useful to optimize the process, provide strain measurements for communications detection in the well, detect leaks due to pressure changes in a well tubular, or a combination thereof;

f) communicating the sensed data to the surface system; and g) using the surface system to selectively actuate the selectively actuated sleeve to selectively choke, occlude, and permit the flow of $CO_2$ by opening and closing the plurality of ports in response to a command from the surface system to equalize the pressure in the well, the command generated responsive to the sensed data.

15. The method of claim 14, wherein:

a) the geological formation comprises a plurality of geological formations; and b) the surface system selectively actuates the selectively actuated sliding sleeve to selectively choke or permit flow of $CO_2$ by opening and closing the plurality of ports in response to a command from the surface system to equalize the pressure in the well to inject a substantially equal amount of $CO_2$ into each geological formation of the plurality of geological formations.

16. The method of claim 14, wherein the selectively actuated sliding sleeve can selectively fully open and fully close the predetermined set of ports and still choke the flow.

17. The method of claim 14, wherein deploying a sleeve system further comprises deploying multiple controlled sleeve systems in the well, the method further comprising:

a) deploying the multiple controlled sleeve systems into a corresponding set of multiple geological zones; and b) operating the multiple controlled sleeve systems substantially simultaneously to receive the $CO_2$ substantially simultaneously, increasing an amount of $CO_2$ volume that can be injected in the well over a period of time.

18. The method of claim 14, wherein:

a) the geological formation comprises a plurality of geological formations; and b) the surface system selectively actuates the selectively actuated sliding sleeve to selectively choke the flow of $CO_2$ by opening and closing the plurality of ports in response to a command from the surface system to equalize the pressure in the well to inject a substantially equal amount of $CO_2$ into each geological formation of the plurality of geological formations.

19. The method of claim 14, further comprising communicating data and commands between the surface system and the sleeve system wirelessly using acoustic pulses created at the surface and detected downhole.

20. The method of claim 14, wherein deploying the controlled sleeve system occurs through tubing using a slickline or an electric line or by attaching the controlled sleeve system to tubing or casing and deploying the controlled sleeve system in the well along with the tubing or the casing.

* * * * *